United States Patent [19]

Frehn

[11] 4,156,606

[45] May 29, 1979

[54] HARD-MATERIAL ALLOY FOR USE IN TOOL PARTS AND PARTS SUBJECT TO WEAR

[75] Inventor: Fritz Frehn, Krefeld, Fed. Rep. of Germany

[73] Assignee: Thyssen Edelstahlwerke AG, Krefeld, Fed. Rep. of Germany

[21] Appl. No.: 850,193

[22] Filed: Nov. 10, 1977

[30] Foreign Application Priority Data

Nov. 18, 1976 [DE] Fed. Rep. of Germany ..... 2652509

[51] Int. Cl.[2] ..... B22F 3/00; C22C 29/00

[52] U.S. Cl. ..... 75/236; 75/243

[58] Field of Search ..... 75/237, 243

[56] References Cited

U.S. PATENT DOCUMENTS

| | | | |
|---|---|---|---|
| 3,720,504 | 3/1973 | Frehn | 75/238 |
| 3,811,961 | 5/1974 | Weinstein et al. | 75/238 |

FOREIGN PATENT DOCUMENTS

| | | |
|---|---|---|
| 2059251 | 6/1972 | Fed. Rep. of Germany. |
| 2075192 | 8/1971 | France. |
| 1293610 | 10/1972 | United Kingdom. |

OTHER PUBLICATIONS

Bain et al., Alloying Elements in Steel, 2nd Ed., ASM, (1966), pp. 242–243.

*Primary Examiner*—Brooks H. Hunt
*Attorney, Agent, or Firm*—Kenyon & Kenyon

[57] ABSTRACT

A sintered hard-material alloy for use in tool parts and parts subject to wear having a coefficient of heat expansion approximately equal to that of tool steel. The hard material alloy consists essentially of 15 to 80% by weight of hard material, preferably titanium carbide, and 20 to 80% by weight of steel with:

0.25 to 0.9% carbon;
5 to 35% chromium;
2 to 5.0% molybdenum;
0 to 3.0% manganese;
0 to 1.0% silicon;
0 to 3.0% copper;
0 to 1% vanadium
0 to 6.0% cobalt;
0 to 0.5% niobium;
0 to 0.01% boron;
0 to 1.8% nickel;
0.5 to 1.8% aluminum; and
remainder iron.

A tool part having a tool body member made of tool steel and an insert made of the above mentioned hard material alloy.

5 Claims, No Drawings

HARD-MATERIAL ALLOY FOR USE IN TOOL PARTS AND PARTS SUBJECT TO WEAR

BACKGROUND OF THE INVENTION

Machinable and hardenable alloys of hard material are known in many variations. Because these hard material alloys have an alloy content of nearly 50 volume percent carbide, preferably titanium carbide, thermal expansion of these alloys is less than tool steel. Since these hard material alloys are often undetachably joined to tool steel by a sintered bond, the differences in thermal expansion of the tool steel and the hard materials create stresses between the alloys which can generate cracks under a slight temperature rise.

If the hard material alloy is joined to tool steel by a detachable joint, such as by fitting, bolting, cementing or the like, the differences in thermal expansion of the hard material alloy and the tool steel will create air gaps between the two alloys when the tool steel and/or the hard material alloy are heated up. These air gaps create a situs for pieces of the material be be machined, e.g., plastic, to settle to become a hard to remove burr between the machine parts.

In order to eliminate this problem, attempts were made in the past to formulate hard material alloys having a coefficient of thermal expansion as close as possible to that of the tool steel to which it will be joined.

Hard material alloys having the composition disclosed herein, minus the aluminum content, are known in the art. Examples of these alloys are seen in German Patents Nos. 2,000,257; 2,008,197 and 2,059,251.

Accordingly, it is an object of the invention to formulate a hard material alloy which can be joined to a tool steel member by a sintered bond wherein no cracks will be created as the tool is heated up.

It is a further object of the invention to formulate a hard material alloy which can be detachably joined to a tool steel member wherein there will be no air gaps created at the alloy interface upon heating.

It is a further object of the invention to create a hard material alloy having a coefficient of thermal expansion approximately equal to the tool steel to which it is joined.

SUMMARY OF THE INVENTION

According to the present invention, a hard material alloy of the type described, by weight, consists essentially of from 15 to 80% of a hard material, preferably titanium carbide, and 20 to 85% of steel consisting essentially of:

0.25 to 0.9% carbon;
5.0 to 35% chromium;
2.0 to 5.0% molybdenum;
0 to 3.0% manganese;
0 to 1.0% silicon;
0 to 3.0% copper;
0 to 1.0% vanadium;
0 6.0% cobalt;
0 to 0.5% niobium;
0 to 0.01% boron;
0 to 1.8% nickel;
0.5 to 1.8% aluminum; and
remainder iron.

In a second embodiment, the steel contains 0.3 to 3.0% copper.

According to the present invention, a tool part having a tool body member made of tool steel having a means to mount a hard material member and a hard material member made of the above described hard material alloy.

A tool part having a tool body member made of tool steel having a hard material alloy coating and a coating made of the above described hard material alloy.

DETAILED DESCRIPTION OF THE INVENTION

The coefficient of thermal expansion of known sintered hard material alloys with a steel matrix and tool steels are given below in Table I. The average composition of the alloys listed in Table I are listed in Table II.

Table 1

| Temperature Range | Coefficient of Thermal Expansion $\alpha$ ($10^{-6} \cdot K^{-1}$) for: Alloy 1 | Alloy 2 | Alloy 3 | Alloy 4 | Alloy 5 | Alloy 6 | Alloy 7 | Alloy 8 |
|---|---|---|---|---|---|---|---|---|
| 20°-100° C. | 9.5 | 8.8 | 10.9 | 10.8 | 12.2 | 10.5 | 10.6 | 9.5 |
| 20°-200° C. | 9.5 | 9.4 | 11.9 | 11.6 | 12.9 | 11.0 | 11.6 | 9.4 |
| 20°-300° C. | 9.2 | 9.7 | 12.3 | 12.0 | 13.5 | 11.5 | 12.2 | 9.8 |
| 20°-400° C. | 9.2 | 10.3 | 12.6 | 12.2 | 13.9 | 12.0 | 12.4 | 10.2 |
| 20°-500° C. | 9.5 | 10.7 | 12.9 | 12.4 | 14.2 | 12.0 | 12.7 | 10.5 |
| 20°-600° C. | 9.9 | 10.8 | 13.0 | 12.7 | 14.5 | 12.6 | 12.9 | 10.7 |
| 20°-700° C. | 10.1 | 12.0 | 13.2 | 12.9 | 14.8 | 12.7 | 12.9 | 10.9 |
| 20°-800° C. | 9.9 | 12.1 | 11.4 | 13.1 | 11.6 | 12.9 | 12.9 | 11.1 |

TABLE II

| | TiC | Steel with: | (Percent Composition) C | Si | Mn | Cr | Mo | Cu | Ni | V | W | Al | Fe |
|---|---|---|---|---|---|---|---|---|---|---|---|---|---|
| Alloy 1 | 33 | 67 | 0.65 | — | — | 3.0 | 3.0 | 1.5 | — | — | — | — | remainder |
| Alloy 2 | 33 | 67 | 0.75 | — | — | 1.40 | 3.0 | 0.8 | 0.4 | 0.5 | — | — | remainder |
| Alloy 3 | — | 100 | 2.08 | 0.3 | 0.3 | 11.5 | — | — | — | — | 0.7 | 0.02 | remainder |
| Alloy 4 | — | 100 | 1.6 | 0.3 | 0.4 | 11.5 | 0.6 | — | — | 0.5 | 0.5 | 0.02 | remainder |
| Alloy 5 | — | 100 | 0.2 | 0.3 | 1.3 | 1.2 | — | — | — | — | — | — | remainder |
| Alloy 6 | — | 100 | <0.2 | 0.4 | 0.5 | 13.0 | — | — | — | — | — | — | remainder |
| Alloy 7 | 33 | 67 | 0.75 | — | — | 1.40 | 3.0 | 0.8 | 0.4 | 0.5 | — | 1.0 | remainder |
| Alloy 8 | 33 | 67 | 0.75 | — | — | 1.40 | 3.0 | 0.8 | 0.4 | 0.5 | — | 2.0 | remainder |

If the coefficient of thermal $\alpha$, listed in Table I, of the hard material Alloys 1 and 2 are compared with those of the steel Alloys 3 to 6, it is apparent that the coefficient of thermal expansion $\alpha$ of the steel is higher than that of the hard material alloys. To eliminate the previously mentioned problems of cracking of the sintered hard material alloys or the development of air gaps of the hard material alloy fitted into the steel member, the differences in the coefficients of thermal expansion must be minimized.

In order to solve the problem of the differences in coefficients of thermal expansion, alloying materials must be selected which have large coefficients of thermal expansion $\alpha$ with increasing temperature. However, the materials selected must not easily react with the carbon in the matrix to form carbides which will lower the coefficient of thermal expansion $\alpha$ and thereby increase the difference between the coefficients of thermal expansion $\alpha$ of the hard material alloy and the tool steel. It was found that use of aluminum as an alloying element increases the coefficient of thermal expansion $\alpha$ of hard material alloys without the embrittlement effect resulting from formed carbides in the matrix.

As seen in Table I, a comparison of the coefficients of thermal expansion $\alpha$ shows a considerably more favorable correlation between the coefficient of thermal expansion $\alpha$ of Alloy 7 and steel Alloys 3 to 6. The increase in coefficient of thermal expansion $\alpha$ of Alloy 7 was achieved by adding, according to the invention, 1% of alloy weight of aluminum in the form of a preliminary alloy consisting of 50% by weight of aluminum and 50% by weight iron, to the steel matrix, according to Table II. The coefficient of thermal expansion $\alpha$ of Alloy 7 containing 1% aluminum closely approximates the coefficient of thermal expansion $\alpha$ of the tool steel Alloys 3 to 6. This new hard material alloy formulation achieved a considerable increase in the coefficient of thermal expansion $\alpha$ when compared with other existing hard material alloys on the market.

The addition of aluminum to the steel matrix of the hard material alloy does not degrade the mechanical and physical properties to the alloy. The addition of aluminum increases the hardness retention up to 540° C. and the bending strength of the alloy.

The addition of an unlimited amount of aluminum is not advantageous. An increase in the aluminum content in the matrix to 2% brings about a distinct diminution of the coefficient of thermal expansion $\alpha$. This lowering of the coefficient of thermal expansion $\alpha$ is seen in Alloy 8 in Table I. As the aluminum content of the hard material alloy is increased to about 1.8%, there is an embrittlement of the hard material alloy.

The addition of copper as a constituent to the hard material alloy also increases the coefficient of thermal expansion $\alpha$ of the alloy. The coefficient of thermal expansion $\alpha$ of Alloys 1 and 2, both of which contain copper, are greater than those of copper-free hard material alloys.

Hard material alloys of the above mentioned composition can be used in the following applications:

where hard material alloys are undetachably bonded by high temperature brazing, cementing or welding to tool steel; and where hard material alloys are mounted by detachable connections such as by joing, shrinking, pressing, wedging, and the like as used in tool and wear resistance applications.

Some specific examples of the use of this hard material alloy are:

inserts of hard material parts into steel tools at wear points in plastic pressing and injection tools to reduce wear;

reinforcement of working surfaces of hot working tools for converting aluminum alloys, nonferrous metals and steel;

reinforcement of working surfaces of briquetting molds;

reinforcement of the wear surfaces of hot chutes; and reinforcement of slide bars in furnaces and the like.

In describing the new alloys hereinabove and in the claims which follow all references to percentages have reference to percent by weight.

What is claimed is:

1. A sintered steel alloy consisting essentially of, by weight, from 15 to 80% TiC and from 20 to 85% steel consisting essentially of:

0.25 to 0.9% carbon;
5.0 to 35.0% chromium;
2.0 to 5.0% molybdenum;
0 to 3.0% manganese;
0 to 1.0% silicon;
0 to 3.0% copper;
0 to 1.0% vanadium;
0 to 6.0% cobalt;
0 to 0.5% niobium;
0 to 0.01% boron;
0 to 1.8% nickel;
0.5 to 1.8% aluminum; and
remainder iron.

2. The alloy claimed in claim 1 wherein there is 0.3 to 3.0% copper by weight.

3. The alloy claimed in claim 1 wherein there is 1.0% aluminum by weight.

4. A tool part comprising:

a tool body member made of tool steel having a means to mount a hard material member; and a hard material member made of a sintered steel alloy consisting essentially of, by weight, from 15 to 8% TiC and from 20 to 85% steel consisting essentially of:

0.25 to 0.9% carbon;
5.0 to 35.0% chromium;
2.0 to 5.0% molybdenum;
0 to 3.0% manganese;
0 to 1.0% silicon;
0 to 3.0% copper;
0 to 1.0% vanadium;
0 to 6.0% cobalt;
0 to 0.5% niobium;
0 to 0.01% boron;
0 to 1.8% nickel;
0.5 to 1.8% aluminum; and
remainder iron.

5. A tool part comprising:

a tool body member made of tool steel having a coating; and a coating made of a sintered steel alloy consisting essentially of, by weight, from 15 to 80% TiC and from 20 to 85% steel consisting essentially of:

0.25 to 0.9% carbon;
5.0 to 35.0% chromium;
2.0 to 5.0% molybdenum;
0 to 3.0% manganese;
0 to 1.0% silicon;
0 to 3.0% copper;
0 to 1.0% vanadium;
0 6.0% cobalt;
0 to 0.5% niobium;
0 to 0.01% boron;
0 1.8% nickel;
0.5 to 1.8% aluminum; and
remainder iron.

* * * * *

UNITED STATES PATENT AND TRADEMARK OFFICE

CERTIFICATE OF CORRECTION

PATENT NO. : 4 156 606

DATED : May 29, 1979

INVENTOR(S) : Fritz Frehn

It is certified that error appears in the above-identified patent and that said Letters Patent are hereby corrected as shown below:

In column 2, line 15, change "O 6.0%" to --O to 6.0%--

In column 3, line 35, change "...properties to..." to --...properties of...--

In column 4, line 62, change "O 6.0%" to -- O to 6.0%-- line 65, change "O 1.8%" to -- O to 1.8%--

Signed and Sealed this

*Fifth* Day of *February 1980*

[SEAL]

*Attest:*

SIDNEY A. DIAMOND

*Attesting Officer*

*Commissioner of Patents and Trademarks*